US006302524B1

(12) United States Patent
Roy

(10) Patent No.: US 6,302,524 B1
(45) Date of Patent: Oct. 16, 2001

(54) LIQUID LEVEL CONTROL IN AN ACOUSTIC DROPLET EMITTER

(75) Inventor: Joy Roy, Fremont, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/170,492

(22) Filed: Oct. 13, 1998

(51) Int. Cl.[7] ..... B41J 2/135
(52) U.S. Cl. ..... 347/46
(58) Field of Search ..... 347/46, 44, 20, 347/54, 47

(56) References Cited

U.S. PATENT DOCUMENTS

| | | | | |
|---|---|---|---|---|
| 4,751,530 | * | 6/1988 | Elrod et al. | 347/46 |
| 5,028,937 | | 7/1991 | Khuri-Yakub et al. | 346/140 R |
| 5,041,849 | * | 8/1991 | Quate et al. | 347/46 |
| 5,121,141 | | 6/1992 | Hadimoglu et al. | 346/140 R |
| 5,216,451 | | 6/1993 | Rawson et al. | 346/140 R |
| 5,277,754 | | 1/1994 | Hadimioglu et al. | 156/644 |
| 5,287,126 | | 2/1994 | Quate | 346/140 R |
| 5,354,419 | | 10/1994 | Hadimioglu | 156/644 |
| 5,392,064 | | 2/1995 | Hadimioglu et al. | 347/46 |
| 5,428,381 | | 6/1995 | Hadimioglu et al. | 347/46 |
| 5,450,107 | | 9/1995 | Rawson | 347/46 |
| 5,565,113 | | 10/1996 | Hadimioglu et al. | 216/2 |
| 5,591,490 | | 1/1997 | Quate | 427/457 |
| 5,631,678 | | 5/1997 | Hadimioglu et al. | 156/644 |
| 5,686,945 | | 11/1997 | Quate et al. | 347/46 |
| 5,796,416 | * | 8/1998 | Silverbrook | 347/47 |
| 5,821,958 | * | 10/1998 | Lim | 347/46 |
| 6,074,040 | * | 6/2000 | Usui et al. | 347/47 |

FOREIGN PATENT DOCUMENTS

| | | | |
|---|---|---|---|
| 0 572 241 A | | 12/1993 | (EP) . |
| 0 683 405 A1 | | 11/1995 | (EP) . |
| 0 493 102 A1 | * | 1/1992 | (GB) B41J/2/04 |

* cited by examiner

*Primary Examiner*—John Barlow
*Assistant Examiner*—Robert D Loper, Jr.
(74) *Attorney, Agent, or Firm*—Nola Mae McBain

(57) ABSTRACT

An acoustic droplet emitter which a liquid level control plate has a lip in intimate contact with the free surface of a liquid is constructed. The liquid level control plate also has an effective aperture diameter at the exit edge of the plate which is larger than the effective aperture diameter at the lip. This reduces the pressure sensitivity of the free surface of the liquid and allows for the free surface of the liquid to be effectively pinned at the bottom surface of liquid level control plate for wider variations in pressure than using conventional methods.

11 Claims, 4 Drawing Sheets

LIQUID LEVEL CONTROL IN AN ACOUSTIC DROPLET EMITTER

INCORPORATION BY REFERENCE

The following US patents are fully incorporated by reference:

- U.S. Pat. No. 4,308,507 titled "Liquid Drop Emitter" by Lovelady et al., issued Dec. 29$^{th}$, 1981,
- U.S. Pat. No. 4,697,195 titled "Nozzleless Liquid Droplet Ejectors", by Quate et. al., issued Sep. 29$^{th}$, 1987,
- U.S. Pat. No. 5,041,849 titled "Multi-Discrete-Phase Fresnel Acoustic Lenses And Their Application To Acoustic Ink Printing" to Quate et al., issued Aug. 20$^{th}$, 1991,
- U.S. Pat. No. 5,121,141 titled "Acoustic Ink Printhead With Integrated Liquid Level Control Layer" to Hadimioglu et al., issued Jun. 9$^{th}$, 1992,
- U.S. Pat. No. 5,608,433 titled "Fluid Application Device And Method Of Operation" by Quate, issued Mar. 4$^{th}$, 1997,
- U.S. Pat. No. 5,591,490 titled "Acoustic Deposition Of Material Layers" by Quate, issued Jan. 7$^{th}$, 1997,
- U.S. Pat. No. 5,565,113 titled "Lithographically Defined Ejection Units" by Hadimioglu et al., issued Oct. 15$^{th}$, 1996,
- U.S. Pat. No. 5,520,715 titled "Directional Electrostatic Accretion Process Employing Acoustic Droplet Formation" by Oeftering, issued May 28$^{th}$,
- U.S. Pat. No. 5,121,141, titled "Acoustic Ink Printhead With Integrated Liquid Level Control Layer", by Hadimioglu et al., issued Jun. 9$^{th}$, 1992,
- U.S. Pat. No. 5,450,107, titled "Surface Ripple Wave Suppression By Anti-Reflection In Apertured Free Ink Surface Level Controllers For Acoustic Ink Printers", by Rawson, issued Sep. 12$^{th}$, 1995,
- U.S. Pat. No. 4,751,529, titled "Microlenses For Acoustic Printing", by Elrod et al., issued Jun. 14$^{th}$, 1988,
- U.S. Pat. No. 5,028,937, titled "Perforated Membranes For Liquid Contronlin Acoustic Ink Printing", by Khuri-Yakub et al., issued Jul. 2$^{nd}$, 1991,
- U.S. Pat. No. 5,216,451, titled "Surface Ripple Wave Diffusion In Apertured Free Ink Surface Level Controllers For Acoustic Ink Printers", by Rawson et al., issued Jun. 1$^{st}$, 1993,
- U.S. Pat. No. 5,277,754, titled "Process For Manufacturing Liquid Level Control Structure" by Hadimioglu et al., issued Jan. 11$^{th}$, 1994,
- U.S. Pat. No. 5,392,064 titled "Liquid Level Control Structure" by Hadimioglu et al., issued Feb. 21$^{st}$, 1995,
- U.S. Pat. No. 5,565,113 titled "Lithographically Defined Ejection Units" by Hadimioglu et al., issued Oct. 15$^{th}$, 1998, and
- U.S. Pat. No. 5,686,945 titled "Capping Structures For Acoustic Printing" by Quate et al., issued Nov. 11$^{th}$, 1997.

BACKGROUND

This invention relates generally to acoustic droplet emission and more particularly concerns a capping structure which provides liquid level control and meniscus placement for an acoustic droplet emitter.

Turning now to FIG. 1 a device which generates liquid droplets using focussed acoustic energy is shown. Such devices are known in the art for use in printing applications. Detailed descriptions of acoustic droplet formation and acoustic printing can be found in the following U.S. patent applications Ser. No. 4,308,507 titled "Liquid Drop Emitter" by Lovelady et al., issued Dec. 29$^{th}$, 1981; U.S. patent application Ser. No. 4,697,195 titled "Nozzleless Liquid Droplet Ejectors", by Quate et. al., issued Sep. 29$^{th}$, 1987; U.S. patent application Ser. No. 5,041,849 titled "Multi-Discrete-Phase Fresnel Acoustic Lenses And Their Application To Acoustic Ink Printing" to Quate et al., issued Aug. 20$^{th}$, 1991; U.S. patent application Ser. No. 5,121,141 titled "Acoustic Ink Printhead With Integrated Liquid Level Control Layer" to Hadimioglu et al., issued Jun. 9$^{th}$, 1992; U.S. patent application Ser. No. 5,608,433 titled "Fluid Application Device And Method Of Operation" by Quate, issued Mar. 4$^{th}$, 1997, all herein incorporated by reference, as well as other patents.

The most important feature of the device shown in FIG. 1 is that it does not use nozzles and is therefore unlikely to clog, especially when compared to other methods of forming and ejecting small, controlled droplets. The device can be manufactured using photolithographic techniques to provide groups of densely packed emitters each of which can eject carefully controlled droplets. Furthermore, it is known that such devices can eject a wide variety of materials, U.S. Pat. No. 5,591,490 titled "Acoustic Deposition Of Material Layers" by Quate, issued Jan. 7$^{th}$, 1997 and herein incorporated by reference, describes a method for using an array of such acoustic droplet emitters to form a uniform layer of resist, U.S. Pat. No. 5,565,113 titled "Lithographically Defined Ejection Units" by Hadimioglu et al., issued Oct. 15$^{th}$ 1996, and herein incorporated by reference, states that the principles of Acoustic Ink Printing (AIP) are suitable for ejection of materials other than marking fluids, such as mylar catalysts, molten solder, hot melt waxes, color filter materials, resists, chemical compounds, and biological compounds. U.S. Pat. No. 5,520,715 titled "Directional Electrostatic Accretion Process Employing Acoustic Droplet Formation" by Oeftering, issued May 28$^{th}$, 1996, and herein incorporated by reference describes using focussed acoustic energy to emit droplets of liquid metal.

With the above concepts firmly in mind, the operation of an exemplary acoustic droplet emitter will now be described. There are many variations in acoustic droplet emitters and the description of a particular droplet emitter is not intended to limit the disclosure but to merely provide an example from which the principles of acoustic droplet generation can be applied in the context of this invention.

FIG. 1 shows an acoustic droplet emitter 10 shortly after emitting of a droplet 12 of a liquid 14 and before a mound 16 on a free surface 18 of the liquid 14 has relaxed. The forming of the mound 16 and the subsequent ejection of the droplet 12 is the result of pressure exerted by acoustic forces created by a ZnO transducer 20. To generate the acoustic pressure, RF energy is applied to the ZnO transducer 20 from an RF source 22 via a bottom electrode 24 and a top electrode 26. The acoustic energy from the transducer 20 passes through a base 28 into an acoustic lens 30. The acoustic lens 30 focuses its received acoustic energy into a small focal area which is at or very near the free surface 18 of the liquid 14. It should be noted that while the acoustic lens 30 is depicted as a fresnel lens, that other lenses are also possible. For example, concave acoustic beam forming devices such as that shown in U.S. Pat. No. 4,751,529, titled "Microlenses For Acoustic Printing", by Elrod et al., issued Jun. 14$^{th}$, 1988 have also been used. Provided the energy of the acoustic beam is sufficient and properly focused relative to the free surface 18 of the liquid 14, a mound 16 is formed and a droplet 12 is subsequently emitted on a trajectory T.

The liquid is contained by a plate 34 which has a opening 32 in which the free surface 18 of the liquid 14 is present and from which the droplet 12 is emitted. The liquid 14 flows through a channel defined by sidewalls 36 and the top surface 38 of base 28 and past the acoustic lens 30 without disturbing the free surface 18. Although the sidewalls 36 are depicted as inwardly sloping, resulting in a channel that is narrower at the opening 32 than at the surface 38 of the base 28, this need not be so. Examples of other channel configurations are shown in U.S. Pat. No. 5,121,141, issued Jun. 9$^{th}$, 1992, by Hadimioglu et al., and titled, "Acoustic Ink Printhead With Integrated Liquid Level Control Layer" and U.S. Pat. No. 5,450,107, issued Sep. 12$^{th}$, 1995, by Rawson and titled "Surface Ripple Wave Suppression By Anti-Reflection In Apertured Free Ink Surface Level Controllers For Acoustic Ink Printers", both herein incorporated by reference. The width W of the opening 32 is many times larger than the droplet 12 which is emitted such that the width W of the opening has no effect on the size of the droplet 12 thereby greatly reducing clogging of the opening, especially as compared to other droplet ejection technologies. It is this feature of the droplet emitter 10 which makes its use desirable for emitting droplets of a wide variety of materials. Also important to the invention is the fact that droplet size of acoustically generated and emitted droplets can be precisely controlled. Drop diameters can be as small as 16 microns allowing for the deposition of very small amounts of material.

However, the free surface 18 of the liquid 14 must be a precise focal distance d from the acoustic lens 30 so that the acoustic energy focussed by the acoustic lens 30 can be focussed at or very near to the free surface 18. Variations in the distance d will cause the acoustic energy generated by the transducer 20 to be misfocused by the acoustic lens 30 and often results in misfired droplets 12. Many techniques have been used to control the placement of the free surface 18 relative to acoustic lens 30.

Most commonly, surface tension, fluid pressure, and the edge of an orifice opening are relied upon to place the free surface 18 at the appropriate distance d. If the liquid 14 is supplied at the correct pressure then the surface tension will hold the free surface 18 in place with a meniscus extending between the sidewalls 36, as shown in FIG. 1. If the pressure is increased the liquid 14 will spill through the opening, if the pressure is decreased the free surface 18 of the liquid 14 will slip down the sidewalls 36 of the plate 34 instead of being adjacent to the top surface 40 of the plate 34 as shown in FIG. 1.

This method requires uniformity of the pressure of liquid 14 and is dependent on variations in the thickness of the plate 34. In the case of an acoustic droplet emitter which has a single emitter or a small number of emitters, pressure uniformity can often be sufficiently maintained. However, as the number of emitters disposed in a single channel grow larger, maintaining uniformity can be problematic. Furthermore, the free surface may not be maintained by the sidewalls of the channel but by the sidewalls of a relatively short capping structure as shown in any of U.S. Pat. No. 5,121,141 titled "Acoustic In Printhead With Integrated Liquid Level Control Layer" to Hadimioglu et al., issued Jun. 9$^{th}$, 1992, U.S. Pat. No. 5,450,107, titled "Surface Ripple Wave Suppression By Anti-Reflection In Apertured Free Ink Surface Level Controllers For Acoustic Ink Printers", by Rawson, issued Sep. 12$^{th}$, 1995, U.S. Pat. No. 5,028,937, titled "Perforated Membranes For Liquid Contronlin Acoustic Ink Printing", by Khuri-Yakub et al., issued Jul. 2$^{nd}$, 1991, U.S. Pat. No. 5,121,141 titled "Acoustic In Printhead With Integrated Liquid Level Control Layer" to Hadimioglu et al., issued Jun. 9$^{th}$, 1992, or U.S. Pat. No. 5,216,451, titled "Surface Ripple Wave Diffusion In Apertured Free Ink Surface Level Controllers For Acoustic Ink Printers", by Rawson et al., issued Jun. 1$^{st}$, 1993, Incorporated by reference hereinabove. In these cases, if the pressure drops too low, the free surface will drop below the level of the capping structure and the system will begin to take in air.

Another method has been shown in U.S. Pat. No. 5,277,754, titled "Process For Manufacturing Liquid Level Control Structure" by Hadimioglu et al., issued Jan. 11$^{th}$, 1994, and U.S. Pat. No. 5,392,064 titled "Liquid Level Control Structure" by Hadimioglu et al., issued Feb. 21$^{st}$, 1995, both incorporated by reference hereinabove. These patents describe an hourglass-shaped aperture containing knife edged lips at the waist of the aperture. While this embodiment has the advantage of being independent from variations in wafer thickness it is difficult to manufacture and not as easily extensible to larger numbers of emitters.

Further work has been done in the area as shown in U.S. Pat. No. 5,277,754, titled "Process For Manufacturing Liquid Level Control Structure" by Hadimioglu et al., issued Jan. 11$^{th}$, 1994, and U.S. Pat. No. 5,392,064 titled "Liquid Level Control Structure" by Hadimioglu et al., issued Feb. 21$^{st}$, 1995, both incorporated by reference hereinabove. Structures are shown which utilize acoustically thin capping structures having pores to create accurately positioned fluid wells. As above, these structures are complicated to manufacture and are dependent on variations in thickness of both the substrate and the capping structures.

Accordingly, it is the primary aim of the invention to create a method for precise placement of a liquid with a free surface that is easy to manufacture, easily extensible to many emitters within a single channel, (enabling a high rate of flow of the liquid) and has as few dependencies as possible on thickness variations of various components.

Further advantages of the invention will become apparent as the following description proceeds.

SUMMARY OF THE INVENTION

Briefly stated and in accordance with the present invention, there is provided an acoustic droplet emitter comprising a channel for containing a liquid having spaced apart sidewalls and an opening on an opening plane. Attached to the channel is a liquid level control plate, having a bottom surface coplanar with the opening plane. The liquid level control plate also has a thickness, a top surface, and an aperture with an entrance edge. The aperture has an aperture width and an entrance edge with the entrance edge being so constructed and arranged to hold a meniscus of a liquid contained in said channel substantially at the opening in said channel.

While the present invention will be described in connection with a preferred embodiment and method of use, it will be understood that it is not intended to limit the invention to that embodiment or procedure. On the contrary, it is intended to cover all alteratives, modifications and equivalents as may be included within the spirit and scope of the invention as defined by the appended claims.

DETAILED DESCRIPTION OF THE INVENTION

Figure 1:
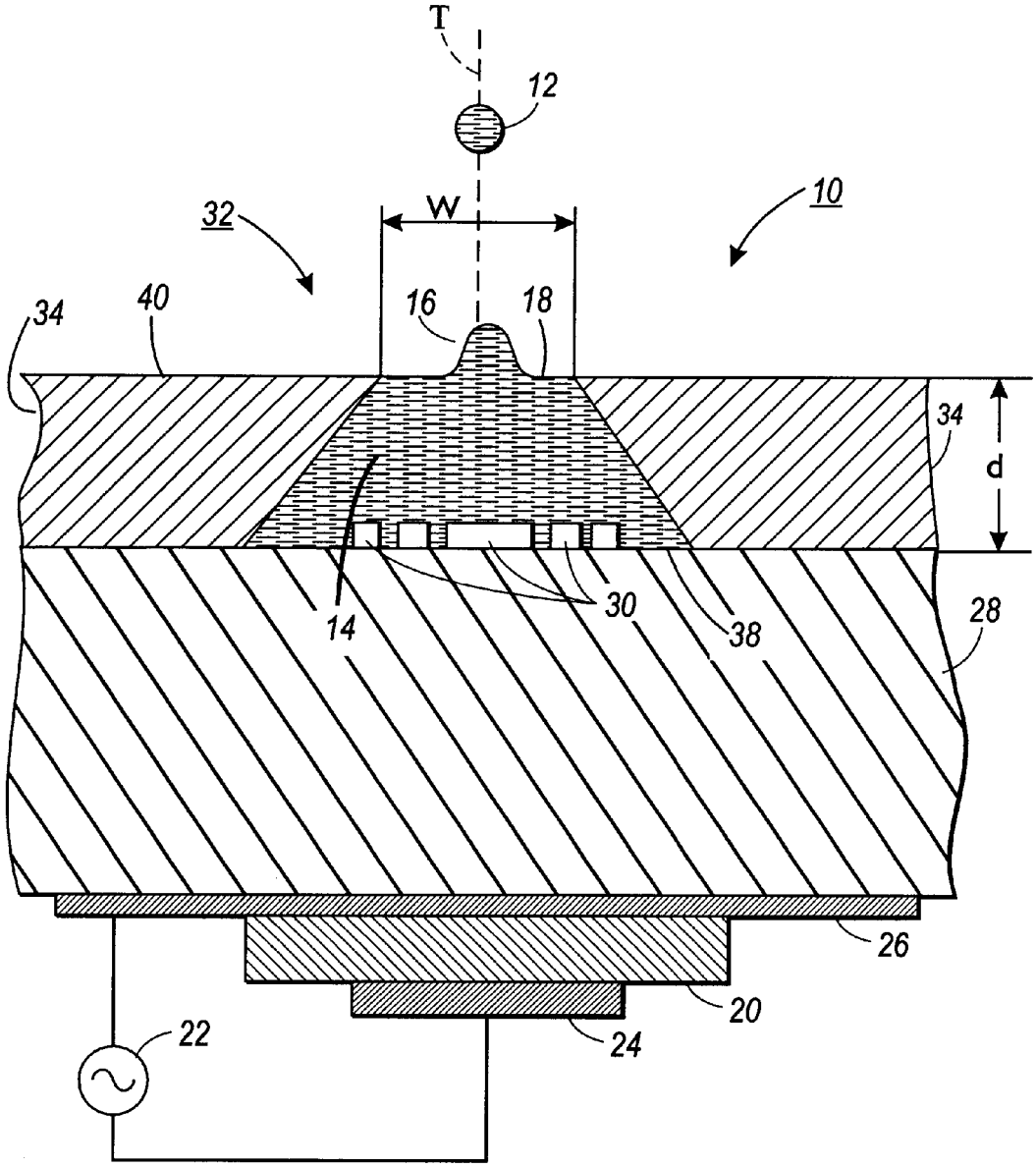
FIG. 1 (Prior Art)
FIG. 1 shows a cross-section of a prior art acoustic droplet emitter.
Figure 2:
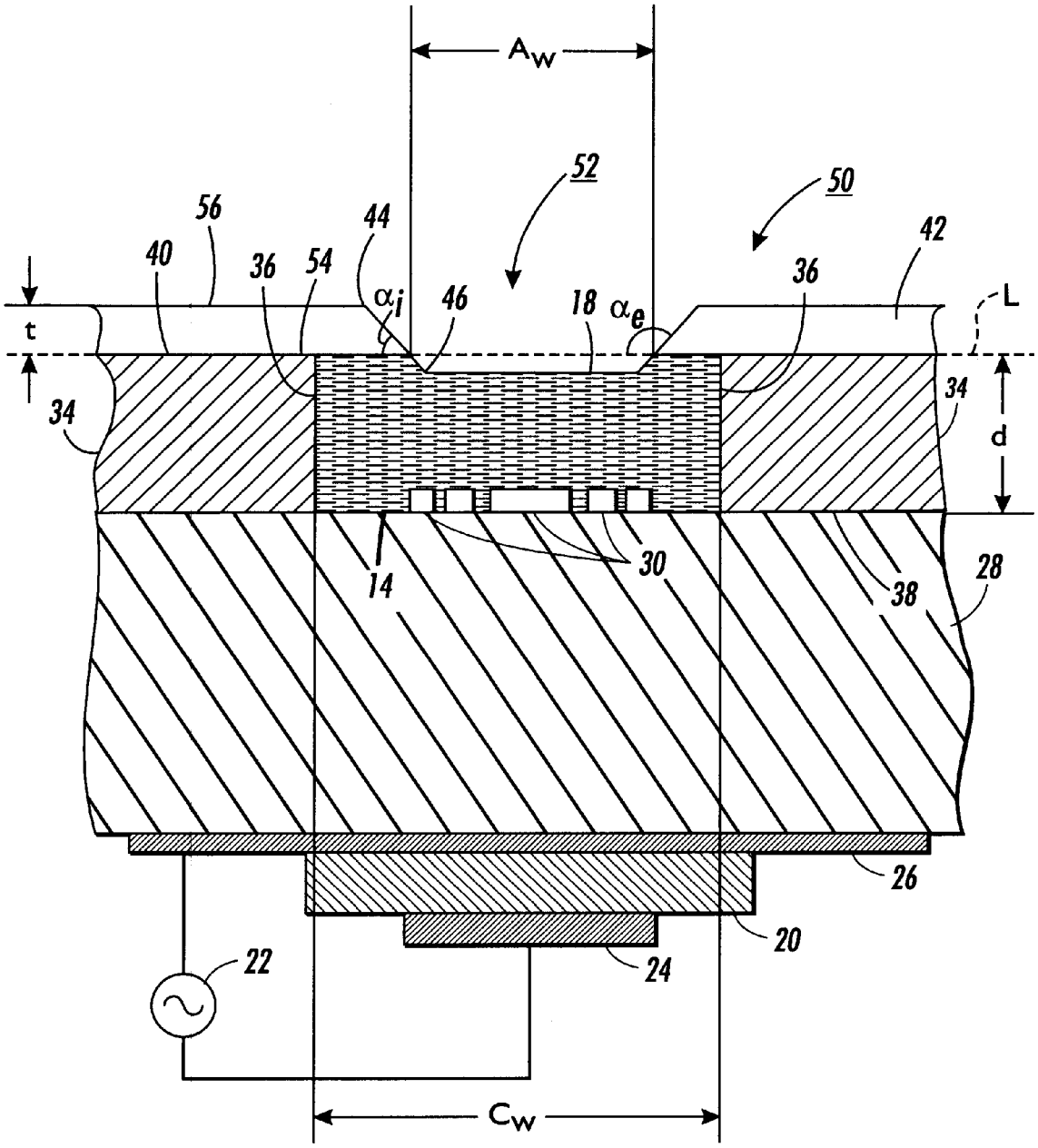
FIG. 2 shows a cross-section of an acoustic droplet emitter using a liquid level control plate according to a first embodiment of the invention.

Turning now to FIG. 2, a cross-section is shown of an acoustic droplet emitter 50 according to a first embodiment of the invention. Acoustic droplet emitter 50 is identical in most respects to acoustic droplet emitter 10 shown in FIG. 1, and therefore the same reference numerals have been used for like elements. Attention will now be focussed on describing the differences between the two droplet emitters. As stated earlier, the sidewalls 36 of the channel need not be sloped and may be substantially vertical as shown in FIG. 2. Furthermore, the distance between the sidewalls 36 is the channel width $C_w$. Additionally, a liquid level control plate 42 has been placed on the top surface 40 of the plate 34.

The liquid level control plate 42 has a thickness t and an aperture 52 with an aperture width $A_w$. The aperture 52 has sloping sidewall 44 and an entrance edge 46 in intimate contact with the liquid 14. The free surface 18 of the liquid 14 is at rest and forms a meniscus which is "pinned" to the entrance edge 46 of the liquid level control plate 42. The entrance edge 46 is formed by outwardly sloping sidewall 44 which meets the bottom surface 54 of the liquid level control plate at a sufficiently sharp angle. The angle is sufficiently sharp if the internal angle $\alpha_i$ is 60 degrees or less, or the corresponding external angle $\alpha_e$ is 120 degrees or more. As shown in FIG. 2, the internal angle $\alpha_l$ is the acute angle measured from the bottom surface 54 to the outwardly sloping sidewall 44. The external angle $\alpha_e$ is the obtuse angle measured from a line L, which extends along the bottom surface 54 of the liquid level control plate and through the aperture 52, to the outwardly sloping sidewall 44. The result is that the aperture 52 is wider at the exit edge 48, where the sloping sidewall 44 meets the top surface 56 of the liquid level control plate, than at the entrance edge 46.

Although structures where the aperture width $A_w$ is equal to the channel width, $C_w$ are certainly feasible, the acoustic droplet emitter will work best when the channel width, $A_w$ is much larger than the aperture width $A_w$. It is desirable for the channel width $C_w$ to be at least a factor of ten larger than the aperture width $A_w$, and preferably, a factor of 50 larger than the aperture width $A_w$. The larger channel width $C_w$ minimizes the pressure drop along the channel to provide a more uniform pressure at all emitters along the channel.

The result of the entrance edge 46 and the outwardly sloping sidewall 44 is to decrease the tendency for the meniscus formed by the free surface 18 to move towards the exit edge 48 with small increases in pressure. By reducing the pressure sensitivity of the meniscus, the meniscus is effectively pinned at the entrance edge 46 for a range of pressures.

Figure 4:
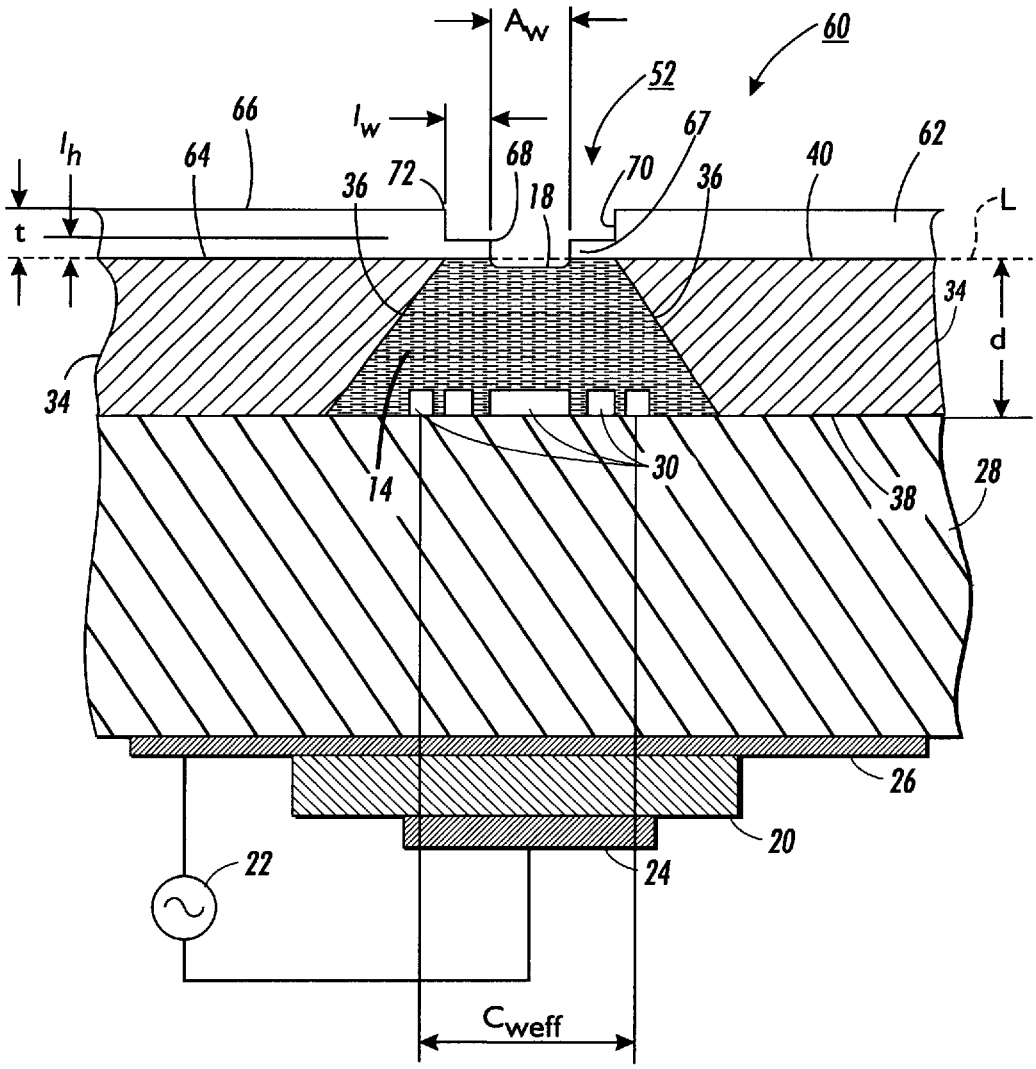
FIG. 4 shows a cross-section of an acoustic droplet emitter using a liquid level control plate according to a third embodiment of the invention.

Having the meniscus pinned for a range of pressures allows for greater tolerance in the maintenance of a uniform pressure. Having the meniscus pinned at the entrance edge 46 for a range of pressures is also useful when constructing an array of acoustic droplet emitters in one channel as shown in FIGS. 4–6 of U.S. Pat. No. 5,565,113 titled "Lithographically Defined Ejection Units" by Hadimioglu et al., issued Oct. 15$^{th}$, 1996, incorporated by reference hereinabove. Even if the fluid 14 is supplied at a constant pressure, as the fluid 14 flows through the channel, it will lose some pressure causing the free surface 18 to drift out of focus with the acoustic lens 30 using conventional methods. As the free surface drifts further out of focus droplet emission is affected, which in turn affects the ability to precisely place any droplets emitted on a receiving substrate (not shown).

Another important feature of the liquid level control plate 42 is that the meniscus is pinned along the bottom surface 54 of the liquid level control plate 42. The impact means that any variations in the thickness t of the liquid level control plate 42 are immaterial to the distance d between the free surface 18 and the acoustic lens 30. Having the location of the free surface independent of thickness variations allows for reduced manufacturing tolerances and lower cost to manufacture the liquid level control plate. This is especially important when the sidewalls of the channel are far apart to enable high liquid flow with a uniform pressure. This allows the liquid level control plate to be made appropriately thick to give it structural stiffness which makes it less sensitive to the liquid pressure and provides general robustness from physical damage.

Figure 3:
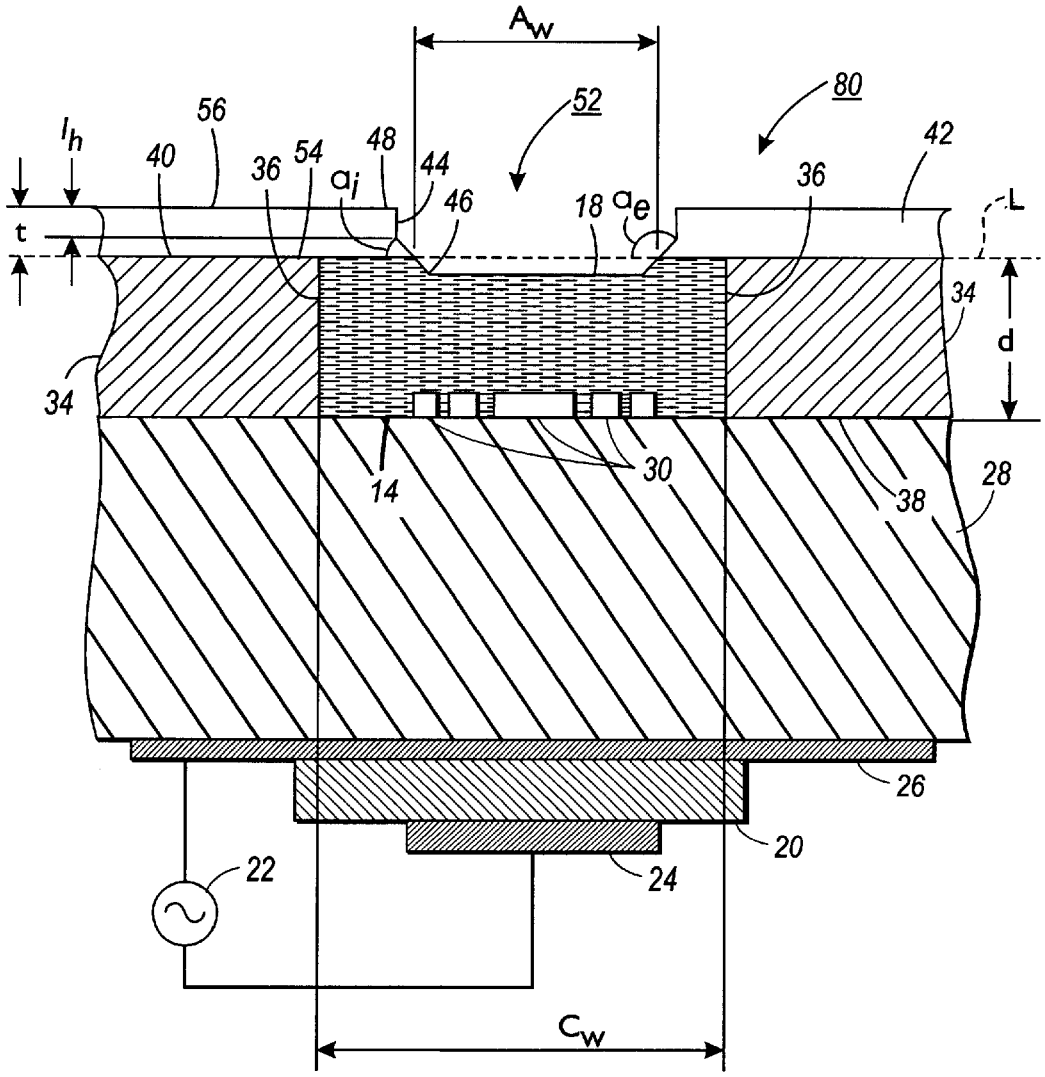
FIG. 3 shows a cross-section of an acoustic droplet emitter using a liquid level control plate according to a second embodiment of the invention.

As stated earlier the sidewall 36 of the plate 34 is shown undercut or pulled back from the entrance edge 46 of the liquid level control plate such that the aperture width $A_w$ is less than the channel width $C_w$. However, this need not be so and structures where the aperture width $C_w$ is equal to the channel width $C_w$ are feasible, even if less desirable. It is shown merely for ease of description. It should also be pointed out that the angles of the sidewall as described above are critical only at the entrance edge of the liquid-level-control-plate and other entrance edge structures are feasible as shown in FIGS. 3 and 4. While this condition will be true when constructing two dimensional arrays of acoustic droplet emitters in a single channel, the liquid level control plate 42 can also be used with a single row of emitters or a single ejector where it need not be so.

Turning now to FIG. 3, a cross-section is shown of an acoustic droplet emitter 80 which is nearly identical to acoustic droplet emitter 50 shown in FIG. 2, and therefore the same reference numerals have been used for like elements. The only difference between the two acoustic droplet emitters 50, 80 is that the entrance edge 46 of liquid level control plate 42 is fabricated with a protruding lip structure which has a lip height $l_h$, which may be arbitrarily small. However, current practical considerations for manufacturing, strength of the lip to prevent breakage, and maintenance suggest that the lip height $l_h$ should be at least 10% of the thickness t of the liquid level control plate 42.

Turning now to FIG. 4, a cross-section is shown of an acoustic droplet emitter 60 according to a third embodiment of the invention. Acoustic droplet emitter 60 is identical in most respects to acoustic droplet emitter 10 shown in FIG. 1, and therefore the same reference numerals have been used for like elements. Attention will now be focussed on describing the differences between the two droplet emitters. The average distance between the sidewalls 36 is the effective channel width $C_{weff}$. A liquid level control plate 62 has been placed on the top surface 40 of the plate 34.

The liquid level control plate 62 has a thickness t and an aperture 52. The aperture 52 has a sidewall 70 with an entrance edge 68, which has been fabricated as a lip 67, in intimate contact with the liquid 14. The free surface 18 of the liquid 14 is at rest and forms a meniscus which is "pinned" to the entrance edge 68 of the liquid level control plate 62. The lip 67 protrudes from the sidewall 70 of sufficient size where it meets the bottom surface 64 of the liquid level control plate 62. The dimensions are sufficient if the ledge has a width $I_w$ of at least 10 percent of the aperture width $A_w$ and a height $I_h$ of at most 3 percent of the focal distance d.

If the aperture is round, then the aperture width $A_w$ will equal the diameter of the aperture. However, if the aperture is oval or polygonal the aperture width $A_w$ will equal the effective diameter of the aperture.

Although structures where the aperture width $A_w$ is equal to the effective channel width $C_{weff}$ are certainly feasible, the acoustic droplet emitter will work best when the effective channel width $C_{weff}$ is much larger than the aperture width $A_w$. It is desirable for the channel width $C_{weff}$ to be at least a factor of ten larger than the aperture width $A_w$, and preferably, a factor of 50 larger than the aperture width $A_w$. The larger effective channel width $C_{weff}$ minimizes the pressure drop along the channel to provide a more uniform pressure at all emitters along the channel.

As shown in FIG. 4, the ledge width $I_w$ is measured radially outward from the lip 67 and the ledge height $I_h$ is measured from a line L, which extends along the bottom surface 64 of the liquid level control plate 62 and through the aperture 52 upward. The result is that the aperture 52 is wider at the exit edge 72 than at the entrance edge 68.

The result of the lip 67 is to decrease the tendency for the meniscus formed by the free surface 18 to move towards the exit edge 72 with small increases in pressure. By reducing the pressure sensitivity of the meniscus, the meniscus is effectively pinned at the lip 67 for a range of pressures. Having the meniscus pinned for a range of pressures allows for greater tolerance in the maintenance of a uniform pressure. Having the meniscus pinned at the lip 67 for a range of pressures is also useful when constructing an array of acoustic droplet emitters in one channel as shown in FIGS. 4–6 of U.S. Pat. No. 5,565,113 titled "Lithographically Defined Ejection Units" by Hadimioglu et al., issued Oct. 15$^{th}$, 1996, incorporated by reference hereinabove. Even if the fluid 14 is supplied at a constant pressure, as the fluid 14 flows through the channel, it will lose some pressure causing the free surface 18 to drift out of focus with the acoustic lens 30 using conventional methods. As the free surface drifts further out of focus droplet emission is affected, which in turn affects the ability to precisely place any droplets emitted on a receiving substrate (not shown).

Another important feature of the liquid level control plate 62 is that the meniscus is pinned along the bottom surface 64 of the liquid level control plate 62. The impact means that any variations in the thickness t of the liquid level control plate 62 are immaterial to the distance d between the free surface 18 and the acoustic lens 30. Having the location of the free surface independent of thickness variations allows for reduced manufacturing tolerances and lower cost to manufacture the liquid level control plate. This is especially important when the sidewalls of the channel are far apart to enable high liquid flow with a uniform pressure. This allows the liquid level control plate to be made appropriately thick to give it structural stiffness which makes it less sensitive to the liquid pressure and provides general robustness from physical damage.

It should also be pointed out that the sidewall 36 of the plate 34 is shown rising steeply from the lip 67. This need not be so and so long as the constraints on ledge height and width are met, a wide variety of curves may be used. Furthermore, the sidewall 36 is shown undercut or pulled back from the entrance edge 68 of the liquid level control plate 62, however, this also need not be so. It is shown merely for ease of description. While this condition will be true when constructing two dimensional arrays of acoustic droplet emitters in a single channel, the liquid level control plate 62 can also be used with a single row of emitters or a single ejector where it need not be so.

The liquid level control plates described above may be manufactured with a wide variety of known in the art manufacturing techniques. For instance, known etching techniques may be used to make the sloped edges described in liquid level control plate 50 shown in FIG. 2. The aperture structure may also be produced using known laser ablation and micropunching techniques. A combination of these techniques may also be used. For instance, a two step micropunch may be used to create the ledge described in liquid level control plate 62 shown in FIG. 4. Further the high-level control plate may be formed of two laminated plates with the thick portion having the larger less precise hole and the thin portion having the smaller very precise hole coaxial to the previous. The lamination can be achieved by a variety of techniques including plating and cladding.

What is claimed is:

1. An acoustic droplet emitter comprising:

a) a channel for containing a liquid having sidewalls spaced apart a first distance and an opening on an opening plane, b) a liquid level control plate, having a bottom surface coplanar with the opening plane, the liquid level control plate also having a thickness, a top surface, and an aperture with an entrance edge, the aperture having an aperture width, the entrance edge being so constructed and arranged to hold a perimeter of a meniscus of a liquid contained in said channel substantially at the opening in said channel, c) a lens for focussing acoustic soundwaves at a focal plane and operably disposed within the channel, the focal plane being substantially at the meniscus of the liquid, and d) a transducer for generating acoustic soundwaves, said transducer being so constructed and arranged such that at least a portion of the sound waves generated by said transducer will be focussed by said lens.

2. The acoustic droplet emitter of claim 1 wherein the first distance is at least a factor of 10 larger than the aperture width.

3. The acoustic droplet emitter of claim 2 wherein the first distance is at least a factor of 50 larger than the aperture width.

4. The acoustic droplet emitter of claim 1 wherein the entrance edge further comprises an outwardly sloped sidewall such that the aperture width at the bottom surface is smaller than the aperture width at the top surface.

5. The acoustic droplet emitter of claim 4 wherein the entrance edge has an acute internal angle formed by the bottom surface and the outwardly sloping sidewall.

6. The acoustic droplet emitter of claim 5 wherein the acute internal angle is 60 degrees.

7. The acoustic droplet emitter of claim 5 wherein the acute internal angle is less than 60 degrees.

8. The acoustic droplet emitter of claim 4 wherein the entrance edge further comprises a protruding lip having a lip height which is less than the thickness of said liquid level control plate.

9. The acoustic droplet emitter of claim 8 wherein the lip height is at least 10 percent of the thickness of said liquid level control plate.

10. The acoustic droplet emitter of claim 8 wherein the lip further comprises a ledge having a ledge height and a ledge width.

11. The acoustic droplet emitter of claim 10 wherein the ledge has a ledge width of at least 10 percent of the aperture width and a ledge height of less than 3 percent of the focal distance.

* * * * *